US012268258B2

(12) United States Patent
Farmer

(10) Patent No.: US 12,268,258 B2
(45) **Date of Patent: *Apr. 8, 2025**

(54) MAGNETIC GLOVE

(71) Applicant: Pure Source LLC, Annville, PA (US)

(72) Inventor: Joel Farmer, Annville, PA (US)

(73) Assignee: Pure Source LLC, Annville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/476,275

(22) Filed: Sep. 27, 2023

(65) Prior Publication Data

US 2024/0251897 A1 Aug. 1, 2024

Related U.S. Application Data

(63) Continuation-in-part of application No. 29/912,617, filed on Sep. 20, 2023, and a continuation-in-part of application No. 18/163,250, filed on Feb. 1, 2023, now Pat. No. 11,793,253.

(51) Int. Cl.
*A41F 1/06* (2006.01)
*A41D 19/00* (2006.01)

(52) U.S. Cl.
CPC ..... *A41F 1/06* (2013.01); *A41D 19/0055* (2013.01)

(58) Field of Classification Search
CPC ..... A41D 19/0024; A41D 2400/80
See application file for complete search history.

(56) References Cited

U.S. PATENT DOCUMENTS 4,234,202 A 11/1980 Loffelholz
6,014,775 A 1/2000 Missry
6,052,828 A 4/2000 Widdemer
6,163,889 A 12/2000 Tate
6,513,165 B1 * 2/2003 England ..... A63B 71/146 2/160
6,728,971 B1 5/2004 Benavidez
7,146,651 B1 12/2006 Lapin
9,022,873 B2 5/2015 Ramirez
9,457,258 B2 * 10/2016 Ramirez ..... A63B 57/353
9,962,594 B2 * 5/2018 Ramirez ..... A41D 19/01564
10,306,937 B2 6/2019 Ramirez (Continued)

FOREIGN PATENT DOCUMENTS

KR 20210029022 A 3/2021

OTHER PUBLICATIONS

EBAY—Golf Glove Gizmo—The Magnetic Golf Glove Holder—Available from Internet <URL: https://www.ebay.com/itm/272006800079.

(Continued)

*Primary Examiner* — Gloria M Hale

(74) *Attorney, Agent, or Firm* — Gallium Law; Jacob Panangat; Isabel Fox

(57) ABSTRACT

In some embodiments, a glove includes a hand-receiving portion including an opening, four enclosed finger pockets, and an enclosed thumb pocket, whereby the opening is configured to receive a hand of a user, and the hand-receiving portion is configured to enclose the hand of the user. The glove may also comprise a strap extending from the hand-receiving portion adjacent the opening. In some embodiments, the glove includes a magnet housing coupled to the strap and configured to contact a ferromagnetic surface. The glove may include a magnet coupled to the magnet housing.

20 Claims, 15 Drawing Sheets

(56) References Cited

U.S. PATENT DOCUMENTS

| | | | | |
|---|---|---|---|---|
| 10,502,836 | B2 | 12/2019 | Iacono | |
| 10,653,939 | B2 | 5/2020 | Ramirez | |
| 10,744,394 | B2 | 8/2020 | Ramirez | |
| 10,864,428 | B2 | 12/2020 | Ramirez | |
| 11,291,895 | B2 | 4/2022 | Travers | |
| 11,793,253 | B1 * | 10/2023 | Farmer | A41D 19/0024 |
| 2008/0047639 | A1 | 2/2008 | Fox | |
| 2013/0326789 | A1 | 12/2013 | Lehrman | |
| 2014/0189983 | A1 | 7/2014 | Maugham | |
| 2018/0326292 | A1 | 11/2018 | Ramirez | |
| 2021/0077890 | A1 | 3/2021 | Chorne | |
| 2021/0197067 | A1 * | 7/2021 | Ramirez | A41D 19/01547 |
| 2022/0225708 | A1 | 7/2022 | Javed | |

OTHER PUBLICATIONS

STICKIT—Magnetic Golf Clips [2-Pack] Instantly Makes Your Golf Glove, Head Covers, Other Golf Gear & Accessories Magnetic for Convenient Positioning and Quick 'N Easy Use—First available Jul. 22, 2021—Available from Internet <URL: https://www.amazon.com/STICKIT-Instantly-Accessories-Convenient-Positioning/do/B09B2RRQ96>.

The Container Store—X-Large Pro FingerGrip Magnetic Glove Black—Available from Internet <URL: https://www.containerstore.com/s/garage/fingergrip-magnetic-glove/1d?productid=11013099>.

Playmore Products—Handimagnet—Multi-Purpose Clip and Base—Available from Internet <URL: https://handimagnet.com/products/handimagnet-glove-and-base-assembly>.

* cited by examiner

MAGNETIC GLOVE

CROSS-REFERENCE TO RELATED APPLICATIONS

The present application claims priority to U.S. patent application Ser. No. 29/912,617; filed on Sep. 20, 2023; and entitled "MAGNETIC GLOVE," the entire contents of which are incorporated by reference herein.

The present application claims priority to U.S. patent application Ser. No. 18/163,250; filed on Feb. 1, 2023; issued as U.S. Pat. No. 11,793,253 on Oct. 24, 2023; and entitled "MAGNETIC GLOVE," the entire contents of which are incorporated by reference herein.

INTRODUCTION

The present invention relates to sports and recreation apparel and equipment. More specifically, the present disclosure relates to a magnetic glove and the method of attaching the magnetic glove to a ferromagnetic surface.

Many sports or recreation activities include equipment to enable participants to participate fully. The amount of equipment, however, depends on the activity. For example, a pickup soccer game needs only a ball and a few objects to designate a goal. A casual neighborhood baseball game needs at least a ball, a bat, and some base markers. Other activities, like golf, require more specialized equipment such as golf balls, different types of clubs, and, for many golfers, at least one glove.

Golf gloves are commonly worn to improve the golfer's grip on the club. Some golfers also like wearing one or multiple gloves to reduce friction between the club and their hand(s), reducing the chance of blisters. Gloves can even help a golfer stay warm when golfing in cold weather.

Many golfers choose only to wear a single glove and remove it between swings or when putting. Once removed, the glove is usually crumpled up and stuffed in the golfer's pocket or bag until pulled out for the next swing. This practice can leave the glove wrinkled and does not allow the glove to dry out, trapping any moisture (i.e., sweat, rainwater, etc.) within the glove between strokes. In addition to being uncomfortable for the golfer, a damp and wrinkled glove may show signs of wear more quickly, causing the golfer to replace the glove more often than if the glove were allowed to dry adequately between swings. Based on the foregoing, there is a need in the art for a way to store golf gloves such that they can quickly dry while not being worn.

SUMMARY

The disclosure includes a glove comprising a hand-receiving portion including an opening, four enclosed finger pockets, and an enclosed thumb pocket. In some embodiments, the opening is configured to receive a hand of a user, and the hand-receiving portion is configured to enclose the hand of the user. The glove may further comprise a strap extending from the hand-receiving portion adjacent the opening. The strap may include an outer surface configured to contact a ferromagnetic surface and an inner surface located opposite the outer surface. In some embodiments, the strap is configured to at least partially wrap around the user's wrist, whereby the inner surface is fastened to the hand-receiving portion to secure the glove to the hand of the user. The glove may include a cavity located within the strap, which may define an angled base surface. The glove may also include a magnet located within the cavity. The magnet may comprise a coupling surface configured to couple to the ferromagnetic surface and a bottom surface located opposite the coupling surface. In some embodiments, the cavity positions the magnet such that the coupling surface is angled with respect to the outer surface of the strap.

The magnet may define a first location and a second location located opposite the first location. In some embodiments, the first location is located a first distance from the outer surface of the strap, and the second location is located a second distance from the outer surface of the strap. The first distance may be less than the second distance. In some embodiments, the first distance is about 1.5 millimeters, and the second is about 2.75 millimeters. When the magnet is coupled to the ferromagnetic surface, the glove may be configured to rotate so that the opening of the hand-receiving portion hangs below the magnet. In some embodiments, when the magnet is coupled to the ferromagnetic surface, the glove is configured to rotate so that the hand-receiving portion is configured to hang parallel to a ground surface. The angled base surface of the magnet may be angled at about 15 degrees with respect to the outer surface of the strap.

In some embodiments, the outer surface of the strap comprises a textured surface configured to prevent the glove from sliding on the ferromagnetic surface. The textured surface of the strap may comprise a surface selected from the group consisting of an elongated ribbed surface, a grid-patterned surface, and combinations thereof.

The cavity may comprise a material selected from the group consisting of rubber, silicone, polyester, nylon, plastic, cotton, and combinations thereof. In some embodiments, the magnet defines a square shape. The magnet may define a round shape. In some embodiments, the hand-receiving portion comprises a first material, and the strap comprises a second material. The second material may be different from the first material.

In some embodiments, the cavity and the outer surface of the strap are arranged and configured such that the first location of the magnet produces a magnetic force of greater than 2 N, and the second location of the magnet produces a magnetic force of less than 2 N. The cavity and the outer surface of the strap may be arranged and configured such that the first location of the magnet produces a magnetic force of at least 2 N, and the second location of the magnet produces a magnetic force of about 1 N. The magnet may define a third location located between the first and second locations. In some embodiments, the cavity and the outer surface of the strap are arranged and configured such that the third location of the magnet produces a magnetic force less than the magnetic force produced by the first location and greater than the magnetic force produced by the second location.

The disclosure includes a method of attaching a glove to a ferromagnetic surface. In some embodiments, the method comprises coupling a magnet, including a coupling surface, to a glove. The glove may include a hand-receiving portion including an opening, four enclosed finger pockets, and an enclosed thumb pocket. In some embodiments, the opening is configured to receive a hand of a user, and the hand-receiving portion is configured to enclose the hand of the user. The glove may also include a strap extending from the hand-receiving portion adjacent the opening. The strap may also include an outer surface configured to contact a ferromagnetic surface and an inner surface located opposite the outer surface. In some embodiments, the strap is configured to at least partially wrap around the user's wrist, whereby the inner surface is fastened to the hand-receiving portion to secure the glove to the hand of the user. The glove may further comprise a cavity located within the strap, and the cavity may define an angled base surface. In some embodiments, the magnet is located within the cavity. The method may further comprise positioning the magnet, via the cavity, such that the coupling surface is angled with respect to the outer surface of the strap.

In some embodiments, the magnet defines a first location and a second location located opposite the first location. The method may further comprise clocking the magnet such that the first location is located a first distance from the outer surface of the strap and the second location is located a second distance from the outer surface of the strap. In some embodiments, the first distance is less than the second distance. The method may include arranging and configuring the first location of the magnet to exert a magnetic force of at least 2 N and arranging and configuring the second location of the magnet to exert a force of at least 1 N.

In some embodiments, the method includes securing the glove to the ferromagnetic surface and rotating the glove so that the opening of the hand-receiving portion hangs below the magnet and the second location of the magnet is located below the first location of the magnet. When the glove is rotated so that the opening of the hand-receiving portion hangs below the magnet and the second location of the magnet is located below the first location of the magnet, the hand-receiving portion may hang parallel to a ground surface.

The disclosure includes a glove comprising a hand-receiving portion including an opening, four enclosed finger pockets, and an enclosed thumb pocket. In some embodiments, the opening is configured to receive a hand of a user, and the hand-receiving portion is configured to enclose the hand of the user. The glove may further comprise a strap extending from the hand-receiving portion adjacent the opening. The strap may include an outer surface and an inner surface located opposite the outer surface. In some embodiments, the strap is configured to at least partially wrap around the user's wrist, whereby the inner surface is fastened to the hand-receiving portion to secure the glove to the hand of the user. The glove may also include a magnet housing coupled to the strap and configured to contact a ferromagnetic surface, and a magnet coupled to the magnet housing. In some embodiments, the magnet comprises a coupling surface configured to couple to the ferromagnetic surface.

The magnet housing may be configured to protrude from the outer surface of the strap. In some embodiments, the magnet housing defines a substantially circular perimeter. The magnet housing may comprise a center portion and an outer portion surrounding the center portion. In some embodiments, the outer portion is configured to extend from the center portion to an edge of the magnet housing, wherein the edge contacts the strap. The outer surface of the strap may be configured to substantially surround the edge of the magnet housing. In some embodiments, the outer portion is configured to taper from the center portion to the edge of the magnet housing such that the magnet housing defines a mound shape.

The magnet housing may comprise a textured surface configured to prevent the glove from sliding on the ferromagnetic surface. In some embodiments, the textured surface comprises a material selected from the group consisting of rubber, silicone, and combinations thereof. The hand-receiving portion may comprise a first material, and the strap may comprise a second material that is different from the first material. In some embodiments, the hand-receiving portion comprises a first material, the strap comprises a second material that is the same as the first material, and the magnet housing comprises a third material that is different from the first material and the second material.

The disclosure includes a glove comprising a hand-receiving portion including an opening, four enclosed finger pockets, and an enclosed thumb pocket. In some embodiments, the opening is configured to receive a hand of a user, and the hand-receiving portion is configured to enclose the hand of the user. The glove may further comprise a strap extending from the hand-receiving portion adjacent the opening. The strap may include an outer surface configured to contact a ferromagnetic surface and an inner surface located opposite the outer surface. In some embodiments, the strap is configured to at least partially wrap around the user's wrist, whereby the inner surface is fastened to the hand-receiving portion to secure the glove to the hand of the user. The glove may include a cavity located within the strap and a magnet coupled to the strap and located within the cavity. The magnet may comprise a coupling surface configured to couple to the ferromagnetic surface.

In some embodiments, the magnet is sized and configured to produce a magnetic pull force sufficient to secure the glove to the ferromagnetic surface and resist the force of gravity when the glove is hanging from the ferromagnetic surface. The magnet may be arranged and positioned within the strap to produce a magnetic pull force sufficient to secure the glove to the ferromagnetic surface and resist the force of gravity when the glove is hanging from the ferromagnetic surface. In some embodiments, the magnet is arranged and positioned such that when the magnet is coupled to the ferromagnetic surface, the glove rotates so that the opening of the hand-receiving portion hangs below the magnet. The magnet may be arranged and positioned such that when the magnet is coupled to the ferromagnetic surface, the glove rotates so that the hand-receiving portion hangs substantially parallel to a ground surface.

In some embodiments, the outer surface of the strap comprises a textured surface configured to prevent the glove from sliding on the ferromagnetic surface. The textured surface may comprise a surface selected from the group consisting of an elongated ribbed surface, a grid-patterned surface, and combinations thereof. In some embodiments, the cavity comprises a material selected from the group consisting of rubber, silicone, polyester, nylon, plastic, cotton, and combinations thereof. The magnet may define a shape selected from the group consisting of a rectangular shape, a round shape, and an oblong shape. In some embodiments, the hand-receiving portion comprises a first material and the strap comprises a second material, and at least a portion of the second material is different from the first material.

The foregoing, and other features and advantages of the invention, will be apparent from the following, more particular description of the preferred embodiments of the invention, the accompanying drawings, and the claims.

BRIEF DESCRIPTION OF THE DRAWINGS

These and other features, aspects, and advantages are described below with reference to the drawings, which are intended to illustrate, but not to limit, the invention. In the drawings, like characters denote corresponding features consistently throughout similar embodiments.

COMPONENT INDEX

100—glove
102—hand-receiving portion
104—opening
106—finger pockets
108—thumb pocket
110—strap
112—magnet
200*a*—outer surface (of strap)
200*b*—inner surface (of strap)
300—cavity
302—angled base surface (of cavity)
400—ferromagnetic surface
402*a*—first location (of magnet)
402*b*—second location (of magnet)
500—coupling surface (of magnet)
502*a*—first distance
502*b*—second distance
600—glove
602—hand-receiving portion
604—opening
606—glove axis
608—ground axis
610—strap
612—flat magnet
700—glove axis
702—ground axis
800—golf cart
802—motion
804—airflow
900—textured surface
1000*a*—elongated ribbed surface
1000*b*—grid-patterned surface
1000*c*—logo-textured surface
1200—glove
1202—hand-receiving portion
1204—opening
1206—finger pockets
1208—thumb pocket
1210—strap
1212—magnet
1214—magnet housing
1300—circular perimeter (of magnet housing)
1302—center portion (of magnet housing)
1304—outer portion (of magnet housing)
1306—edge (of magnet housing)
1308—outer surface (of strap)
1310—mound shape
1400—first material
1402—second material
1404—third material

DETAILED DESCRIPTION

As mentioned, golf gloves are commonly stuffed into a pocket or bag after use, preventing the gloves from drying between shots. When gloves are not allowed to dry, they can become uncomfortable to wear, may start to smell unpleasant, and can even, over time, become more prone to wear and tear. There is a need for a better way to store gloves that allows them to dry quickly between swings and still be easily grabbed by the golfer. One solution includes incorporating one or multiple magnets into the glove design so that the glove can be easily secured to a golf club or golf cart in the open air rather than balled up and stored in a pocket or bag. This solution has some drawbacks, as using a simple, imprecisely placed magnet fails to optimize airflow through the glove. This disclosure includes precisely placing a magnet at an angle within the glove strap to maximize airflow through the glove, for example, when the glove is secured to a rail of a golf cart, to allow the glove interior to dry while the cart is in motion.

Figure 1:
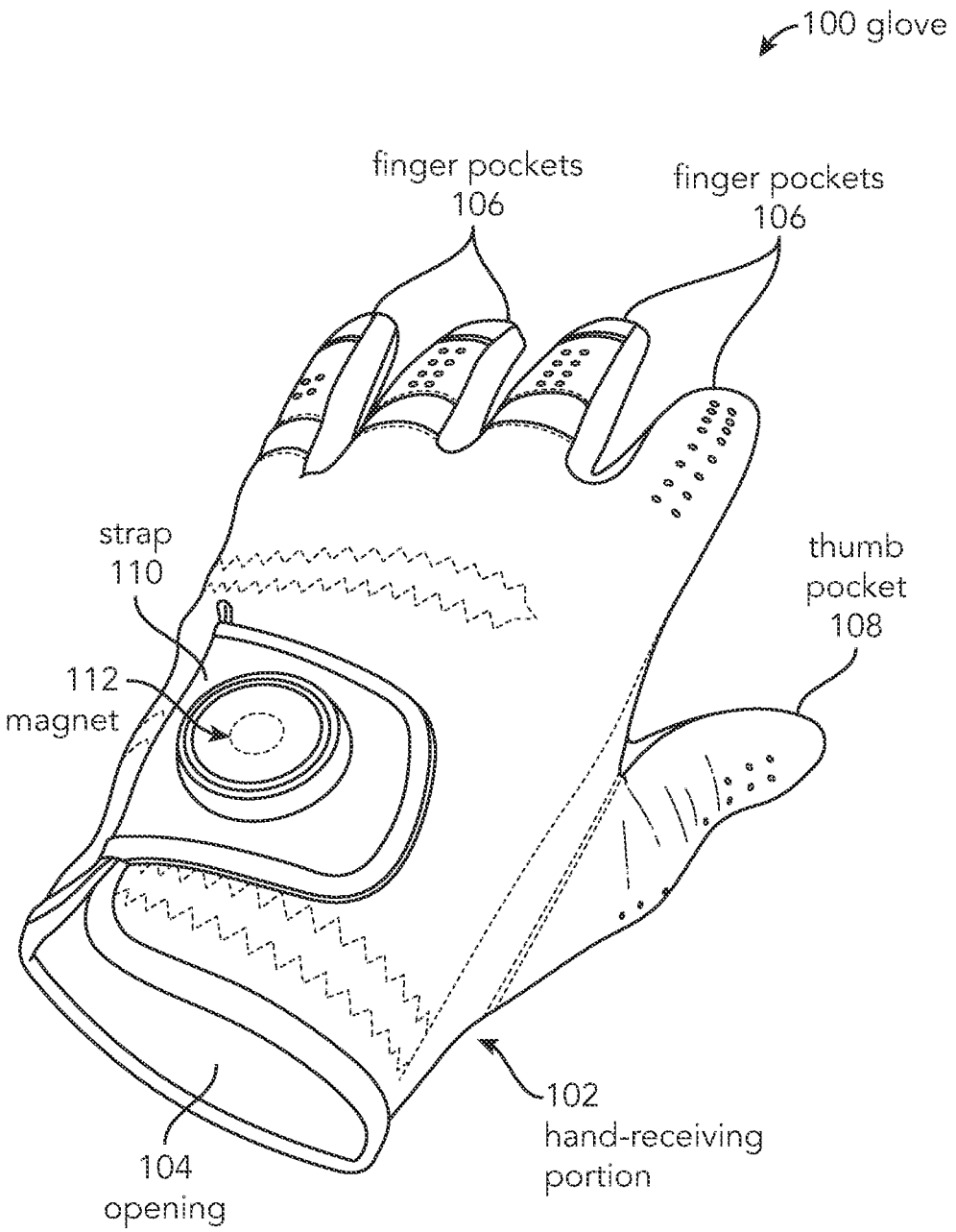
FIG. 1 illustrates a perspective view of a glove, according to an embodiment of the present invention.

FIG. 1 shows a perspective view of glove 100. In some embodiments, the glove 100 comprises a golf glove. The glove 100 may include a glove designed for use in any sports or recreation activities or a plain, non-sport-specific glove. It should be noted that though the Figures illustrate glove 100 as a left-handed glove, the glove 100 may comprise a right-handed glove.

As illustrated in FIG. 1, in some embodiments, the glove 100 includes a hand-receiving portion 102, an opening 104, finger pockets 106, and a thumb pocket 108. The glove 100 may include four finger pockets 106. Any of the finger pockets 106 and the thumb pocket 108 may be "full coverage," as shown in FIG. 1, to entirely enclose the user's fingers and thumb. In some embodiments, any of the finger pockets 106 and the thumb pocket 108 may be open at the end to expose the tip of the user's finger(s) or thumb. The hand-receiving portion 102 may also include any number of holes or other openings for ventilation within the glove 100. In some embodiments, the opening 104 is configured to receive the hand of the user, and the hand-receiving portion 102 is configured to enclose the hand of the user.

The glove 100 may also include a strap 110, as demonstrated in FIG. 1. In some embodiments, the strap 110 is configured to extend from the hand-receiving portion 102 adjacent the opening 104 and is configured to at least partially wrap around a wrist and hand (i.e., the back of the hand) of the user to secure the glove 100 to the user's hand. How the strap 110 couples to the hand-receiving portion 102 of the glove 100 will be discussed in greater detail with reference to FIGS. 2A and 2B. The final element shown in FIG. 1 is magnet 112, illustrated by a dashed circle on strap 110. In some embodiments, magnet 112 is located within a cavity in strap 110, as shown in FIGS. 3A and 3B. The magnet 112 may be configured to couple to a ferromagnetic surface, as will be discussed throughout this disclosure.

Figure 2A:
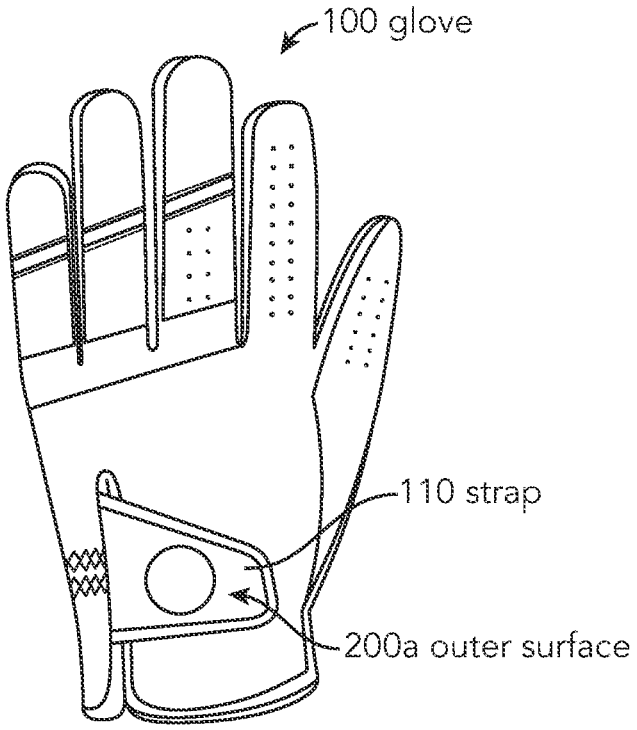
FIGS. 2A and 2B illustrate front views of the glove of FIG. 1 with the strap in two different positions, according to some embodiments of the present invention.
Figure 2B:
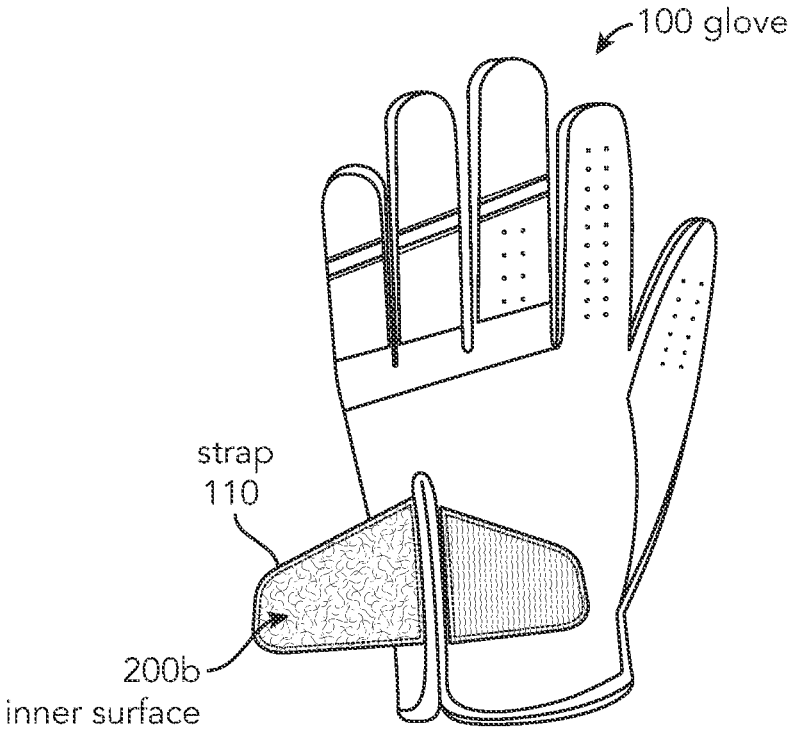
Figure 3A:
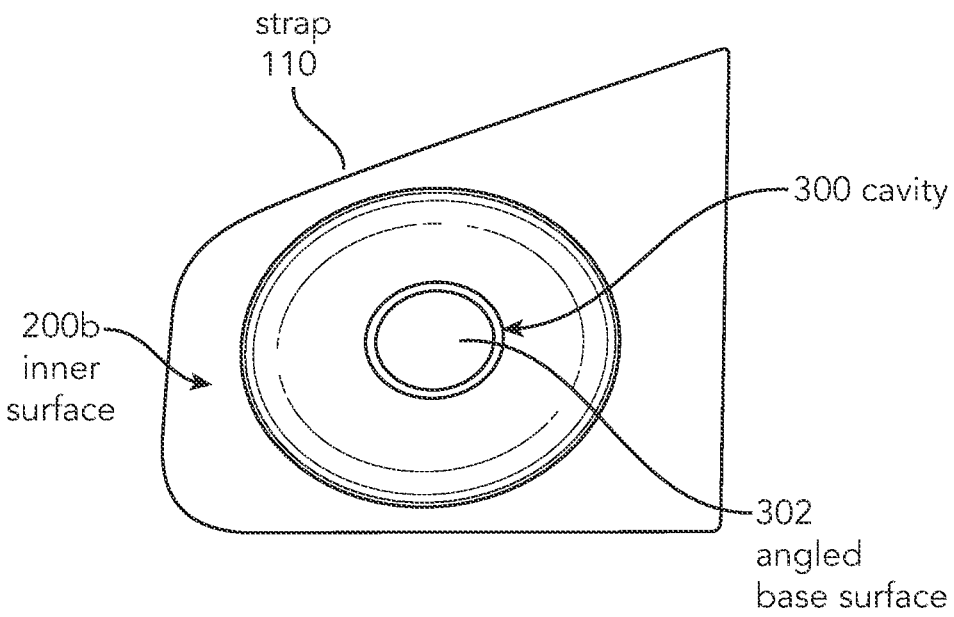
FIG. 3A illustrates an interior view of the strap featuring a cavity, according to an embodiment of the present invention.
Figure 3B:
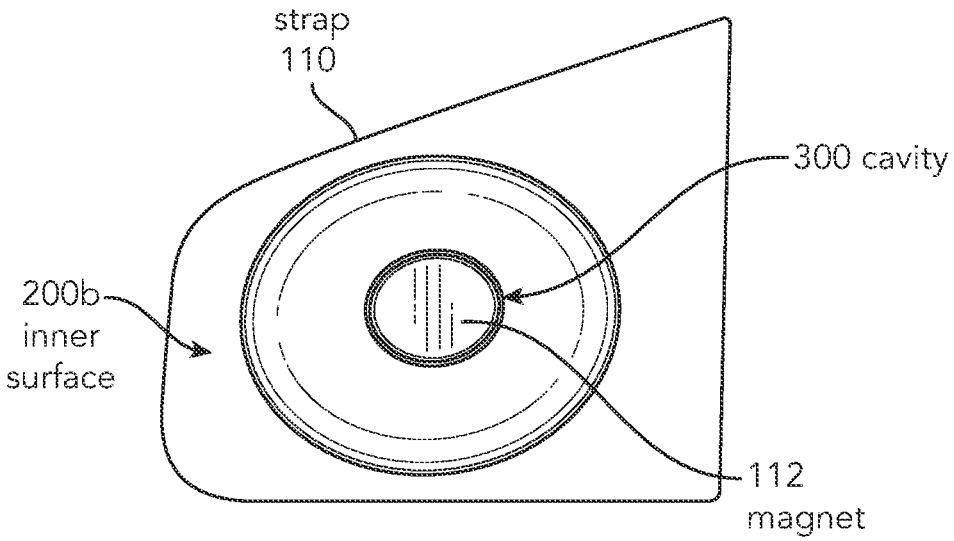
FIG. 3B illustrates an interior view of the strap featuring a magnet coupled to the cavity, according to an embodiment of the present invention.

FIGS. 2A and 2B show front views of glove 100, illustrating strap 110 in different positions. It should be noted that, in this context, the "front" portion of the glove 100 refers to the portion shown in FIGS. 2A and 2B, as opposed to the "back" or "palm" portion of the glove 100. FIG. 2A illustrates the strap 110 in a "closed" or "fastened" position, while FIG. 2B illustrates the strap 110 in an "open" or "unfastened" position.

In some embodiments, strap 110 includes an outer surface 200*a*, shown in FIG. 2A, and an inner surface 200*b*, shown in FIG. 2B, which is located opposite the outer surface 200*a*. The outer surface 200*a* may be configured to contact a ferromagnetic surface to secure the glove 100 to the ferromagnetic surface. Stated differently, in some embodiments, the magnet 112 located within the strap 110 may be strong enough to couple to a ferromagnetic surface through the outer surface 200*a* of the strap 110. The inner surface 200*b* of the strap 110 may be configured to couple to the hand-receiving portion 102, thereby enabling the strap 110 to secure the hand of the user within the glove 100. The inner surface 200*b* and the hand-receiving portion 102 may comprise fastening mechanisms such as, but not limited to, hook-and-loop fastener, one or multiple snaps, one or multiple buttons, one or multiple buckles, one or multiple zippers, and any number of other suitable fastening mechanisms. In some embodiments, the fastening mechanism is adjustable to enable the glove 100 to fit many users with different-sized hands.

FIGS. 3A and 3B illustrate an interior portion of the inner surface 200*b* of the strap 110. In some embodiments, the glove 100 includes a cavity 300 located within the strap 110. The cavity 300 may include an angled base surface 302, as illustrated in FIG. 3A. In some embodiments, the magnet 112 is configured to couple within the cavity 300, as shown in FIG. 3B. The cavity 300 may be configured to position the magnet 112 such that the magnet 112 is angled with respect to the outer surface 200*a* of the strap 110. The angled nature of the magnet 112 will be discussed in greater detail later in this disclosure. The cavity 300 may comprise a number of suitable materials including, but not limited to, rubber, silicone, polyester, nylon, plastic, cotton, and combinations of these. The cavity 300 may comprise an injection-molded material. The magnet 112 may be coupled to the cavity 300 via a friction fit, adhesive, heat bonding, or any number of attachment methods. In addition to any of these listed methods, an interior surface of the strap 110 (e.g., where the strap 110 meets the material of the cavity 300, represented by the dotted shading in FIG. 4A) may help keep the magnet 112 in place with respect to the cavity 300.

In some embodiments, the material of the strap 110 is designed to withstand repeated attachments and detachments to a ferromagnetic surface without breaking down. Accordingly, the material of the strap 110 may be more robust and thicker than other materials of the glove 100, for example, the hand-receiving portion 102. In some embodiments, the hand-receiving portion 102 comprises leather or synthetic leather, and the strap 110 comprises a different material such as, but not limited to, rubber, silicone, polyester, nylon, etc.

Figure 4A:
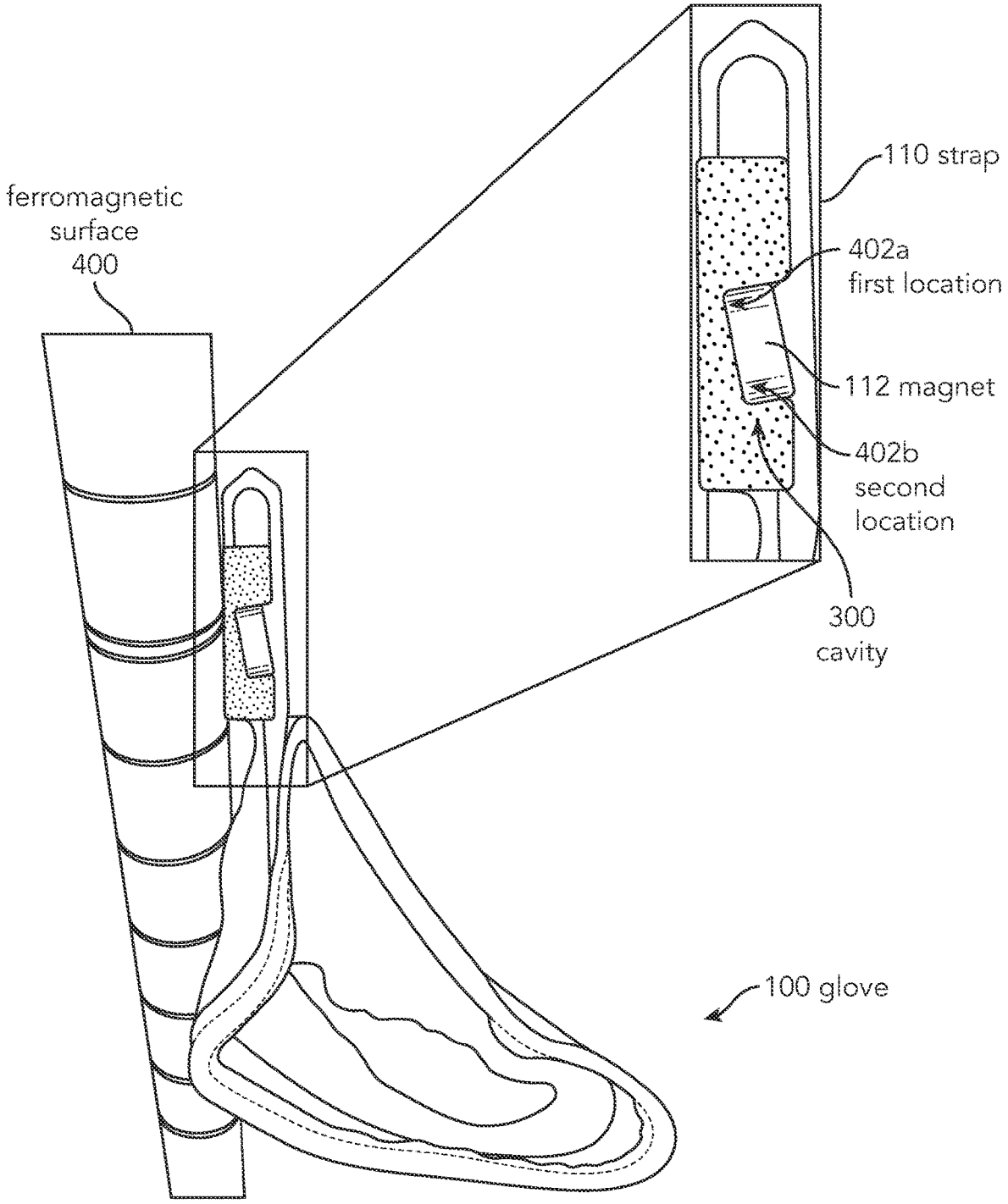
FIG. 4A illustrates a cross-sectional view of the magnet coupled to the strap, according to an embodiment of the present invention.
Figure 8:
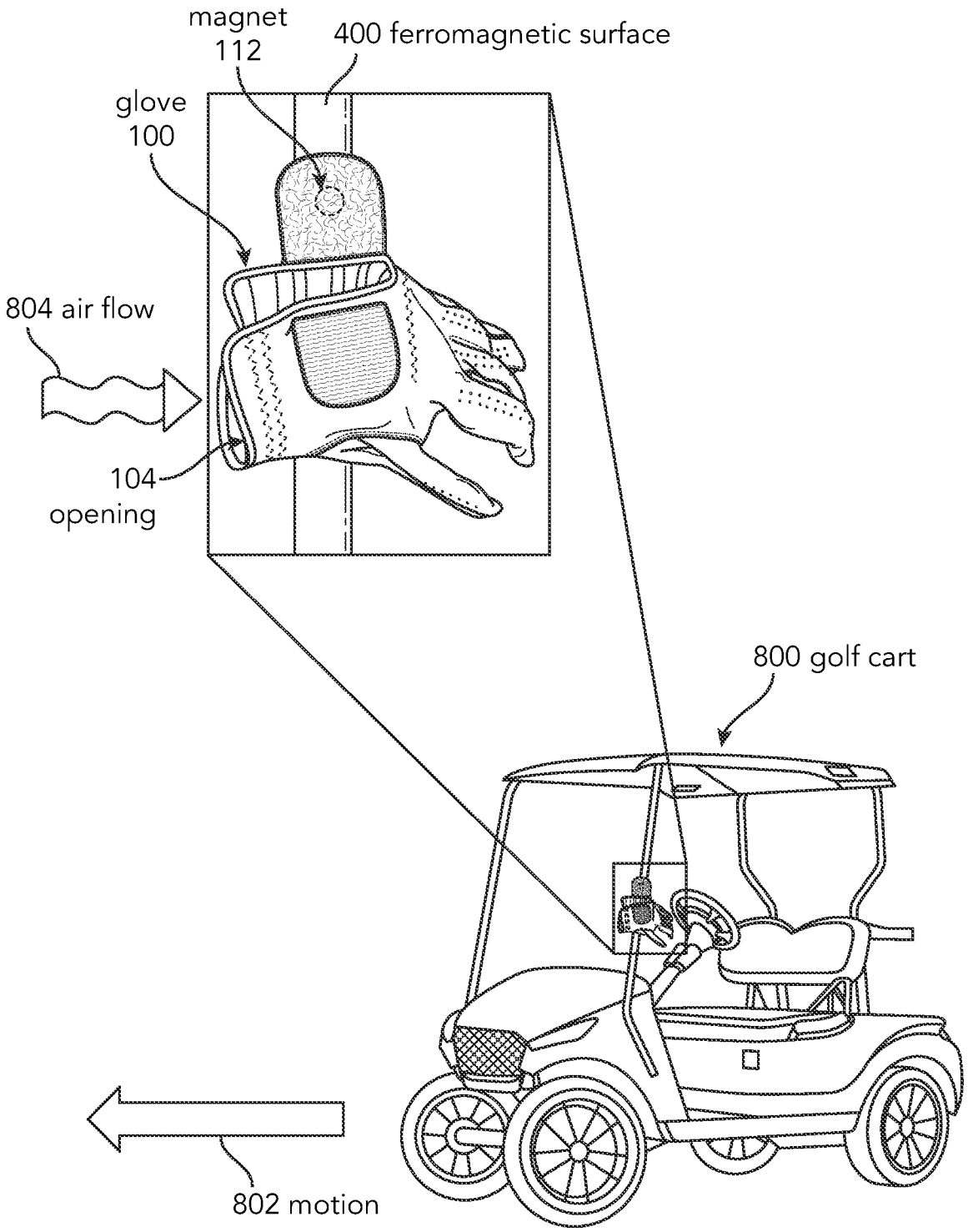
FIG. 8 illustrates a view of the glove of FIG. 1 coupled to a golf cart, according to an embodiment of the present invention.

FIG. 4A shows the glove 100 coupled to a ferromagnetic surface 400 and includes an inset cross-sectional view of the strap 110 of the glove 100. The ferromagnetic surface 400 may comprise any type of magnetic surface including, but not limited to, a vehicle, a golf club, an appliance (e.g., refrigerator), a garage door, a metal workbench, a shelving unit, and, as shown in FIG. 8, the frame of a golf cart.

The inset view in FIG. 4A shows a cross-section of the strap 110, including the cavity 300 housing the magnet 112. As discussed concerning FIGS. 3A and 3B, the cavity 300 may be arranged and configured to position the magnet 112 at an angle with respect to the strap 110 by virtue of a wedge-shaped space within the cavity 300 created by the angled base surface 302 of FIG. 3A. As shown in FIG. 4A, the magnet 112 may include a first location 402*a* and a second location 402*b* located opposite the first location 402*a*. The relative positions of the first location 402*a* and the second location 402*b* within the strap 110 clearly show the angled nature of the magnet 112.

Figure 4B:
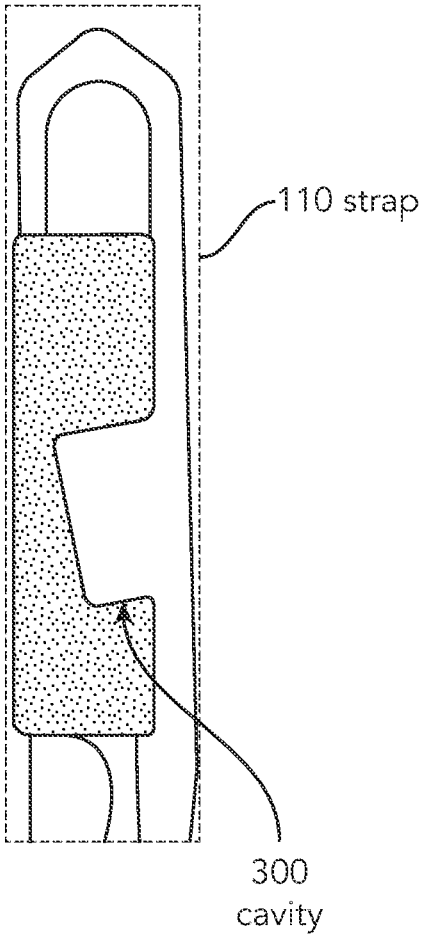
FIG. 4B illustrates a cross-sectional view of the cavity in the strap, according to an embodiment of the present invention.

FIG. 4B illustrates the inset view from FIG. 4A showing the cross-section of the strap 110 and the cavity 300, but without the magnet 112. FIG. 4B illustrates the angled nature of the cavity 300, which may be configured to support the magnet 112 in the angled position shown in FIG. 4A.

Figure 5:
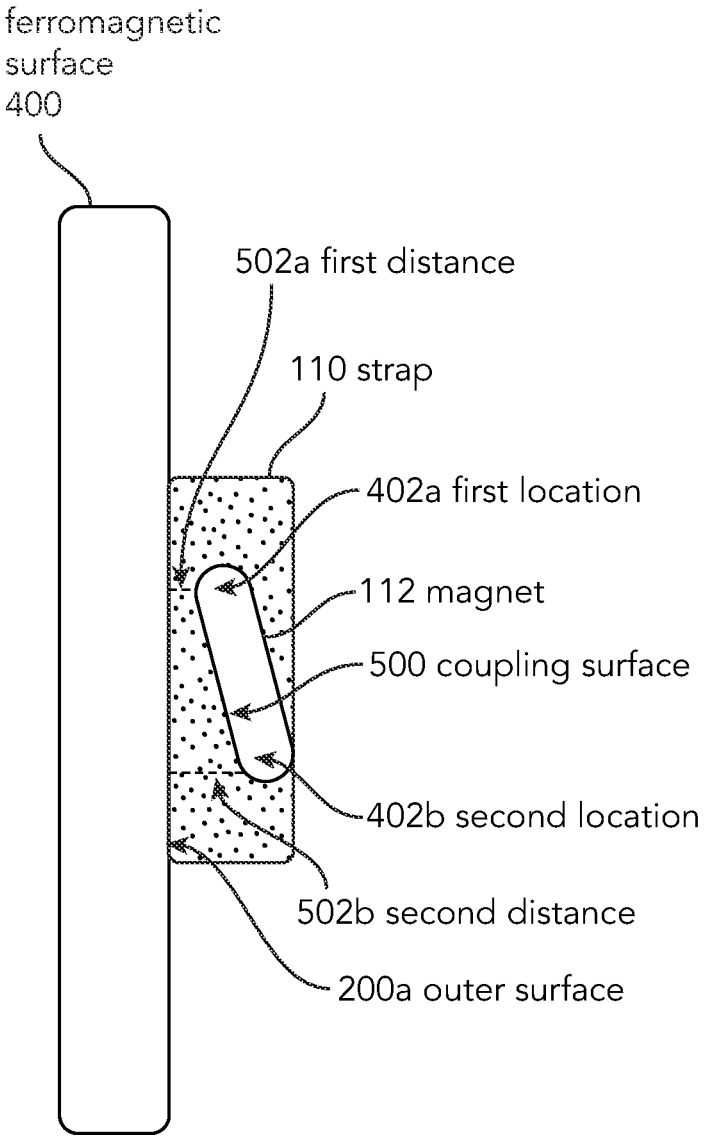
FIG. 5 illustrates a block diagram of a cross-sectional view of the magnet coupled to the strap, according to an embodiment of the present invention.

FIG. 5 is similar to the inset view of FIG. 4A but shows the components in a simplified block diagram format. As shown, the magnet 112 may include a coupling surface 500, which, in some embodiments, is the surface of the magnet 112 configured to couple to the ferromagnetic surface 400 through the outer surface 200*a* of the strap 110. The coupling surface 500 may also be thought of as the surface of the magnet 112 that contacts the angled base surface 302 of the cavity 300. In some embodiments, the cavity 300 positions the magnet 112 such that the coupling surface 500 is angled with respect to the outer surface 200*a* of the strap 110. In some embodiments, the coupling surface 500 is considered offset with respect to the outer surface 200*a* of the strap 110. The coupling surface 500 may also be regarded as planarly offset with respect to the outer surface 200*a* of the strap 110. Stated another way, in some embodiments, the coupling surface 500 is not parallel with respect to the outer surface 200*a* of the strap 110.

Similar to the coupling surface 500, the angled base surface 302 of the cavity 300 may also not be parallel with respect to the outer surface 200*a* of the strap 110. In some embodiments, the angled base surface 302 is angled at about 15 degrees with respect to the outer surface 200*a* of the strap 110. Accordingly, the magnet 112 may also be angled at about 15 degrees with respect to the outer surface 200*a* of the strap 110. The angled base surface 302 and the magnet 112 may be angled at about 15 degrees+/−about 15 degrees. In this disclosure, "about" means "approximately" and includes a tolerance of +/−1 degree. Consequently, the angled base surface 302 and the magnet 112 may define angles in the range of 0 degrees (14 degrees-14 degrees, where 1 degree is subtracted from both starting values of 15 degrees for the tolerance in the understanding of "about") to 32 degrees (16 degrees+16 degrees, where 1 degree is added to both starting values of 15 degrees), and fall into the understood acceptable range disclosed herein.

FIG. 5 also includes the first location 402*a* and the second location 402*b* of the magnet 112, which were introduced in FIG. 4A. In some embodiments, the first location 402*a* is located a first distance 502*a* from the outer surface 200*a* of the strap 110, and the second location 402*b* is located a second distance 502*b* from the outer surface 200*a* of the strap 110. As illustrated in FIG. 5, the first distance 502*a* may be less than the second distance 502*b*. Stated differently, due to the angle of the magnet 112, the first location 402*a* may be located closer to the outer surface 200*a* of the strap 110 than the second location 402*b*. In some embodiments, the first distance 502*a* is about 1.5 mm, and the second distance is about 2.75 mm. The first distance 502*a* may be about 1.5 mm+/−about 1.25 mm, and the second distance 502*b* may be about 2.75 mm+/−about 1.25 mm.

In this disclosure, the term "about" means "approximately" and includes a tolerance of +/−0.1 mm. In other words, the first distance 502*a* may be anywhere in the range from 0.25 mm (1.4 mm-1.15 mm, where 0.1 mm is subtracted from both starting values of 1.5 mm and 1.25 mm for the tolerance in the understanding of "about") to 2.95 mm (1.6 mm+1.35 mm, where 0.1 mm is added to both starting values of 1.5 mm and 1.25 mm for the understanding of "about"). Similarly, the second distance 502*b* may be any distance from 1.5 mm to 4.2 mm, using the same calculations for the starting values of 2.75 mm and 1.25 mm. A person having ordinary skill in the art will understand that any distances in the stated ranges are included in this disclosure.

In some embodiments, when the glove 100 is coupled to the ferromagnetic surface 400, the magnet 112 is predisposed to establish and maintain the orientation shown in FIGS. 4A and 5. In other words, the magnet 112 is configured to rotate the glove 100 to achieve the position where the first location 402*a* is located closest to the outer surface 200*a* of the strap 110 and, therefore, is closest to the ferromagnetic surface 400. This aspect of the present invention may be considered a "clocking feature," where the magnet 112 serves to "clock" (e.g., rotate, turn, swivel, position, etc.) the glove to a specific position, as shown in FIGS. 4A and 5. The driving force behind this clocking feature relates to the angle and position of the magnet 112, as well as the relative magnetic pull forces produced by the first location 402*a* and second location 402*b* of the magnet 112. The value of specific magnetic forces will be discussed in greater detail in FIG. 11. Still, it should be understood that the portion of the magnet 112 located closest to the ferromagnetic surface 400 will create the greatest magnetic pull force. The magnet 112 will cause the glove 100 to move to accommodate this greatest magnetic pull force so that the highest force is oriented to the top (i.e., the first location 402*a* is located above the second location 402*b*, as shown in FIGS. 4A and 5).

Figure 6:
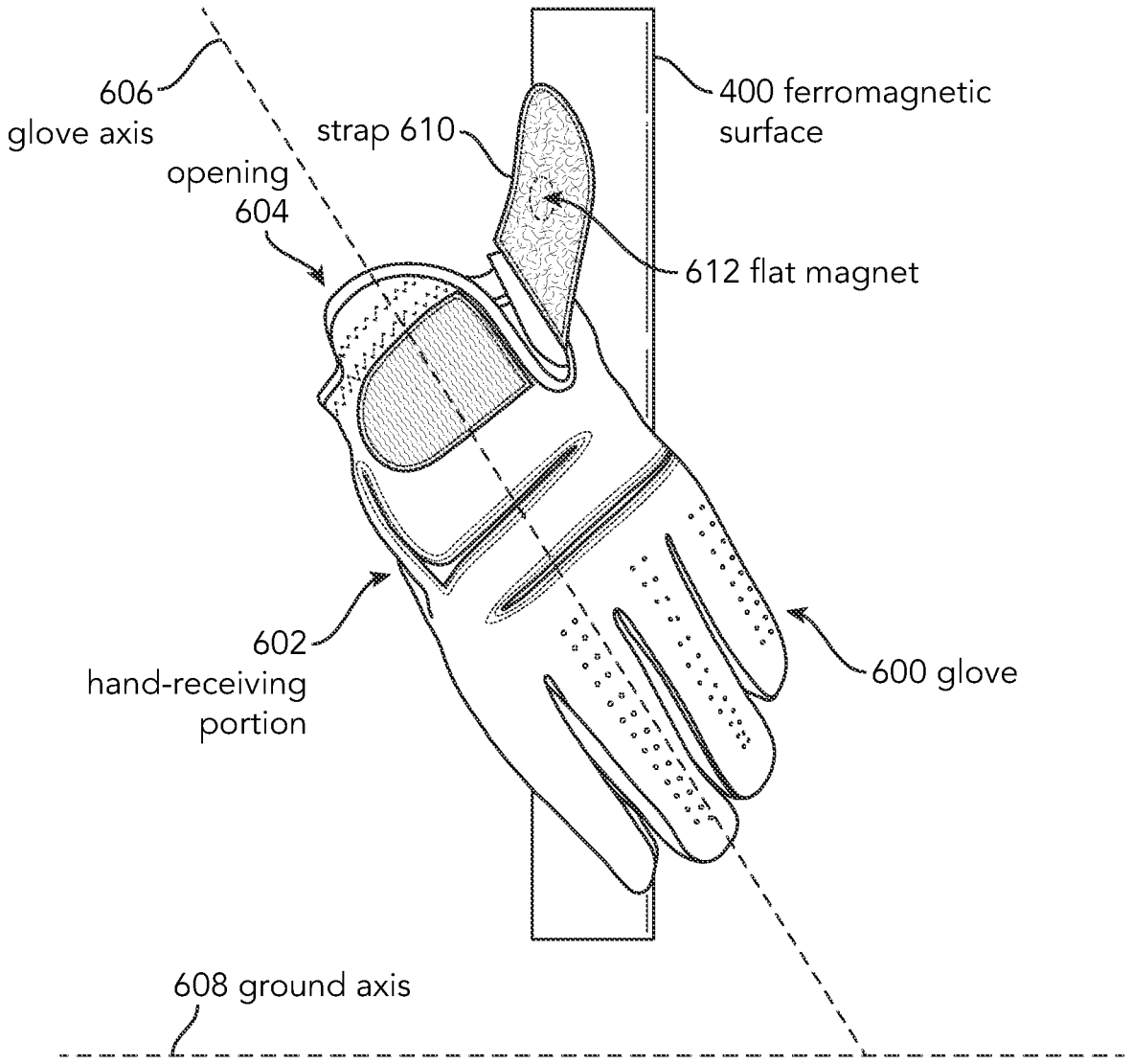
FIG. 6 illustrates a view of a glove coupled to a ferromagnetic surface at an angle, according to an embodiment of the present invention.

Turning to FIG. 6, a glove 600 is shown comprising a hand-receiving portion 602, an opening 604, and a strap 610. The glove 600 is different from the glove 100 previously discussed in this disclosure because the glove 600 includes a flat magnet 612 rather than the magnet 112 of the glove 100, which is held at an angled position. As illustrated in FIG. 6, when the glove 600 with the flat magnet 612 is coupled to the ferromagnetic surface 400, a glove axis 606 is established. The glove axis 606 will line up with whatever position the glove 600 takes when coupled to the ferromagnetic surface 400—in other words, there is no rotating or "clocking" the glove 600 to a specific position because all portions of the flat magnet 612 produce the same magnetic pull force. In contrast, as discussed above, the magnet 112 of the glove 100 includes different portions located at different distances from the ferromagnetic surface 400, and the portion closest produces the greatest magnetic pull force, so the glove 100 with the magnet 112 is clocked into a specific position by that magnetic pull force. FIG. 6 also includes a ground axis 608, which illustrates the angle the glove 600 forms (i.e., the glove axis 606) with respect to the ground.

Figure 7:
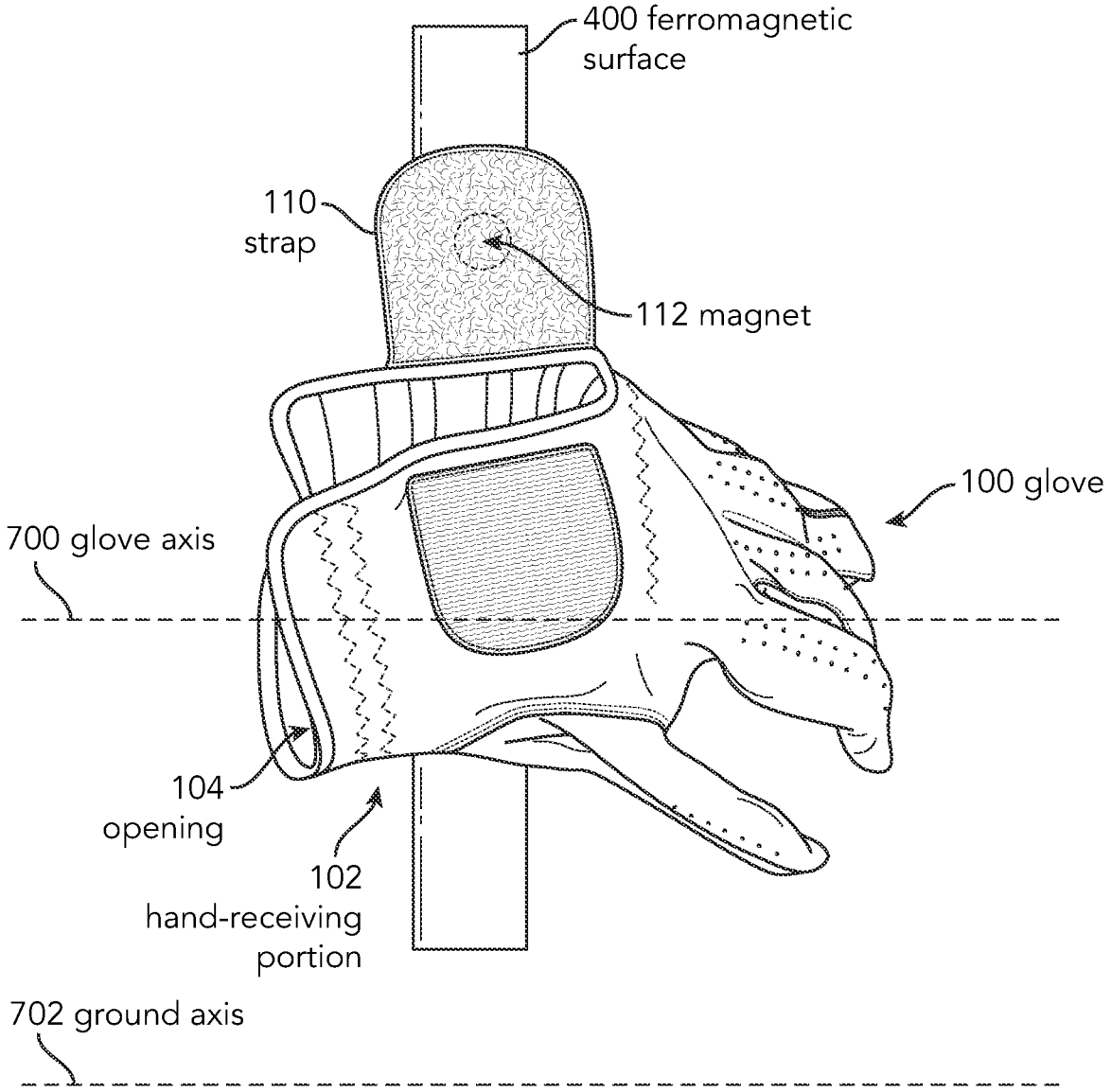
FIG. 7 illustrates a view of the glove of FIG. 1 coupled to the ferromagnetic surface, according to an embodiment of the present invention.

FIG. 7 is similar to FIG. 6, though FIG. 7 illustrates the glove 100 with the magnet 112 and shows the glove axis 700 formed by the glove 100—specifically, the hand-receiving portion 102—when coupled to the ferromagnetic surface 400. In some embodiments, as indicated by the glove axis 700 and the ground axis 702, when the magnet 112 is coupled to the ferromagnetic surface 400 the glove 100 is configured to rotate so that the hand-receiving portion 102 is configured to hang parallel to the ground. The glove 100 may also be configured to rotate so that the opening 104 of the hand-receiving portion 102 hangs below the magnet 112. When considered in conjunction with FIG. 4A, the glove 100 may be further described as being configured to rotate so that the second location 402*b* of the magnet 112 is located below the first location 402*a* of the magnet 112, with the hand-receiving portion 102 hanging below the strap 110 (and, by extension, below the magnet 112).

In some embodiments, saying that the glove 100 is "configured to rotate" is meant to illustrate that, regardless of what position the glove 100 first takes when coupled to the ferromagnetic surface 400, the magnetic pull force between the magnet 112 and the ferromagnetic surface 400 will cause the glove 100 to adopt the position shown in FIG. 7. For example, if the glove 100 of FIG. 7 is haphazardly tossed against the ferromagnetic surface 400, the initial position may involve the second location 402*b* of the magnet 112 above the first location 402*a* of the magnet 112. In this situation, the strap 110 will rotate, thereby rotating the whole glove 100, so that the magnet 112 is oriented with the first location 402*a* located closest to the ferromagnetic surface 400 and above the second location 402*b*, as shown in FIGS. 4A and 5.

In contrast, if the glove 600 of FIG. 6, with the flat magnet 612, is haphazardly tossed at the ferromagnetic surface 400, the glove 600 will maintain whatever position it "lands" in. Gravity will play a part in the position of the glove 600, for example, gravity will cause the finger portion to hang down rather than extend up. However, unlike the glove 100 with the magnet 112, the strap 610 of the glove 600 will not rotate or re-orient itself due to magnetic pull force. This is because the flat magnet 612 exerts equal magnetic pull force across the entire surface, as every location is equally close to the ferromagnetic surface 400. This type of "simple" magnetic connection fails to maximize airflow through the glove 600, as the opening 604 may be pointed down toward the ground or up, as shown in FIG. 6, rather than directly out, as shown in FIG. 7.

In some embodiments, the position of the glove 100, shown in FIG. 7, is designed to orient the glove 100 so that air flows through the glove 100, as illustrated in FIG. 8. FIG. 8 shows a golf cart 800 with the glove 100 coupled to a ferromagnetic surface 400 of the golf cart 800; in this case, a rail of the golf cart 800. As discussed previously in this disclosure, the status quo of golf glove use generally involves cramming the glove in the golfer's pocket or bag between swings. This practice leaves gloves wrinkled and damp with sweat, as they cannot dry. The disclosed invention aims to solve this issue by attaching the glove 100 to a golf cart 800 in a manner that optimizes airflow 804 through the glove 100 when the golf cart 800 is in motion 802, as demonstrated in FIG. 8. As shown in the inset view of FIG. 8, in some embodiments, the glove 100 is configured to open outward (i.e., to the front of the golf cart 800) so that air can flow through the opening 104 and dry the interior of the glove 100. The positioning of the glove 100 is enabled by the angle of the magnet 112, as explained in detail earlier in this disclosure.

Figure 9:
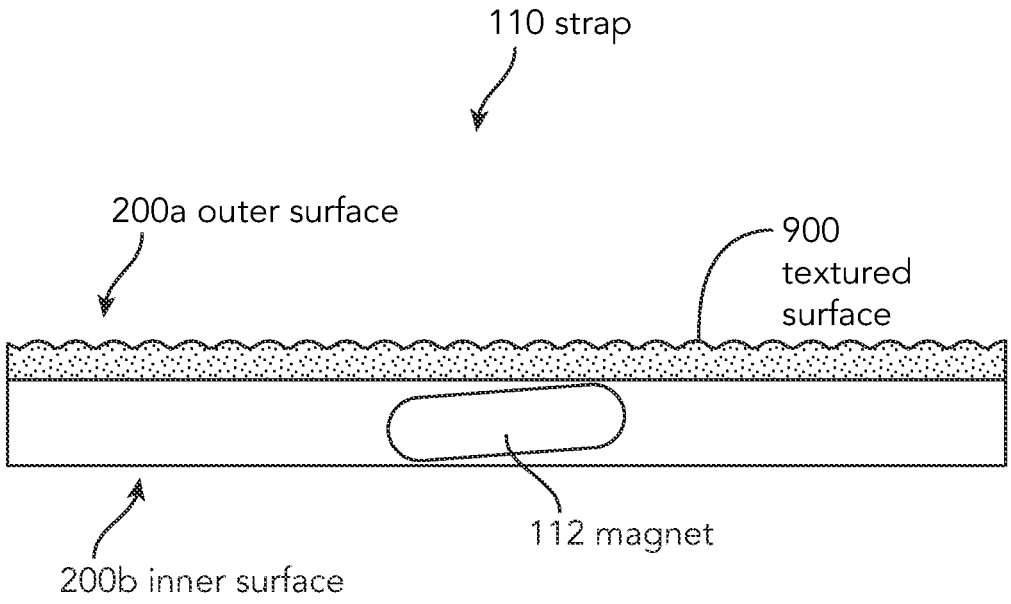
FIG. 9 illustrates a cross-sectional view of the magnet located within the strap, according to an embodiment of the present invention.

FIG. 9 shows a cross-sectional view of the strap 110, including the outer surface 200*a*, the inner surface 200*b*, and the magnet 112. In some embodiments, as shown in FIG. 9, the outer surface 200*a* of the strap 110 comprises a textured surface 900 configured to contact the ferromagnetic surface 400 and prevent the glove from sliding on the ferromagnetic surface 400. For example, when the glove 100 is coupled to the golf cart 800, the textured surface 900 may provide some extra grip to keep the glove 100 coupled to the ferromagnetic surface 400, even as the golf cart 800 drives over bumps, brakes suddenly, or has any other type of jostling movement that would potentially overcome the magnetic pull force and cause the glove 100 to slide down or fall off entirely.

In some embodiments, the textured surface 900 is aligned with the cavity 300 so the magnet 112 is located under the textured surface 900. It should be noted that the textured surface is included in the dimensions disclosed for the first distance 502*a* and the second distance 502*b*, discussed in FIG. 5. Stated differently, the first distance 502*a* may define about 1.5 mm from the coupling surface 500 of the magnet 112 to the outside of the textured surface 900. Stated yet another way, there may be about 1.5 mm of material thickness between the first location 402*a* of the magnet 112 and the outside of the glove 100 or, when coupled, between the first location 402*a* of the magnet 112 and the ferromagnetic surface 400. The textured surface 900 may comprise any number or combination of nonslip materials such as rubber, silicone, or the like.

Figure 10A:
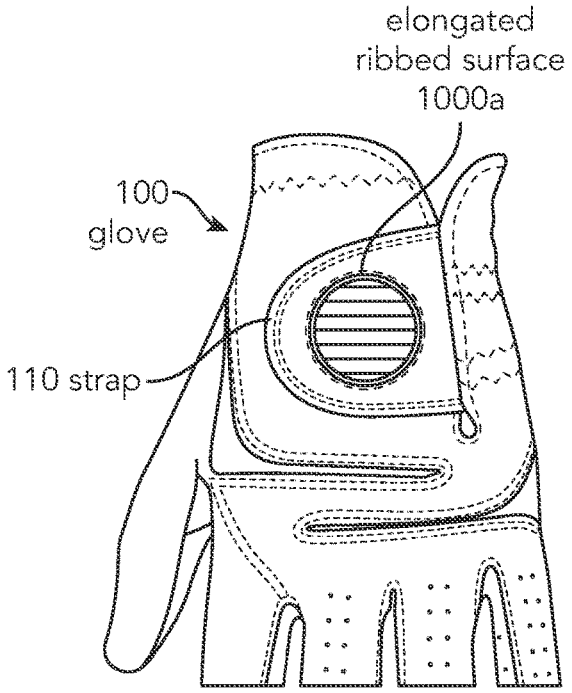
FIGS. 10A, 10B, and 10C each illustrate a view of the glove of FIG. 1 with a different textured surface on the strap, according to some embodiments of the present invention.
Figure 10B:
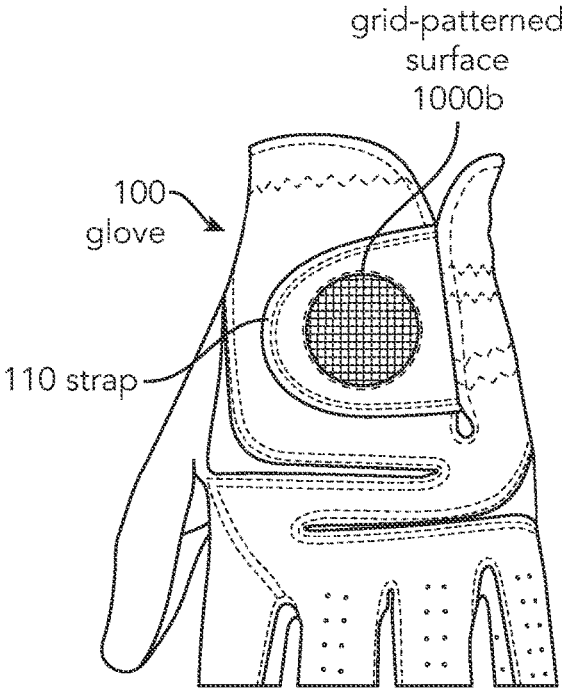
Figure 10C:
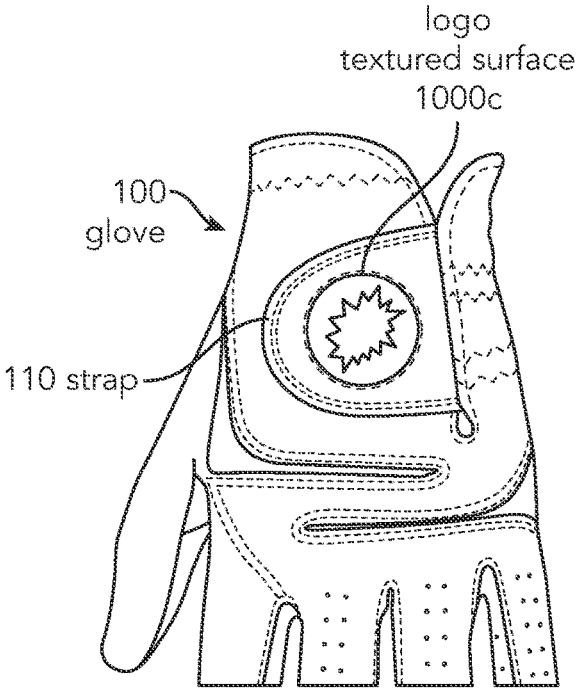

The textured surface 900 may also include several different types of textures, as illustrated in FIGS. 10A-10C. For example, FIG. 10A illustrates that, in some embodiments, the strap 110 includes an elongated ribbed surface 1000*a*. The strap 110 may include a grid-patterned surface 1000*b*, as shown in FIG. 10B, or a logo-textured surface 1000*c*, as shown in FIG. 10C. It should be noted that a "logo-textured surface" means that any logo may be recreated on the strap 110, for example, by adhering a rubberized (or silicone, etc.) version of the logo to the strap 110. The multi-pointed shape in FIG. 10C is used as an example and is not meant to indicate any specific logo design. Other possible textured surfaces include but are not limited to, dimpled surfaces, cross-hatched surfaces, striped surfaces, nodules, bristles, and any number of other raised (i.e., non-flat) surfaces. It should be noted that FIGS. 10A-10C show the textured surfaces located on only a portion of the strap 110. The textured surface may cover more of the outer surface 200*a* of the strap 110 than illustrated in FIGS. 10A-10C. In some embodiments, the textured surface covers less of the outer surface 200*a* of the strap 110 than shown in FIGS. 10A-10C.

Figure 11:
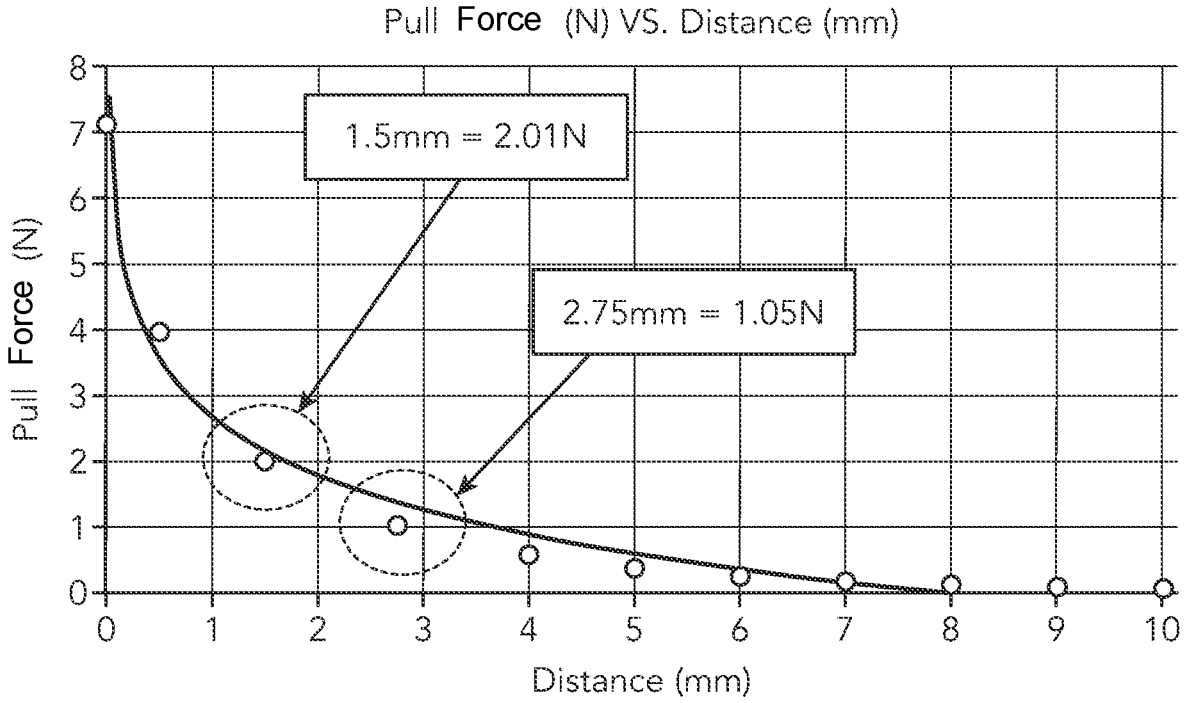
FIG. 11 illustrates a graph of pull force vs. distance between the magnet and the ferromagnetic surface, according to an embodiment of the present invention.

FIG. 11 is a graph of Pull Force, measured in Newtons, vs. Distance, measured in millimeters. In this context, the Pull Force is the magnetic pull force produced by the magnet 112, and the Distance is the distance between the magnet 112 and the ferromagnetic surface 400. It should be noted that the values shown on the graph are specific to a round N50 magnet having a 12 mm diameter and 0.125 in thickness. That is not to say that only this specific type of magnet would be effective for use with the disclosed invention; it is merely an example magnet type. Any number of other types, shapes (e.g., square, rectangular, oblong), and sizes of magnets may be suitable to couple the glove 100 to the ferromagnetic surface 400. In some embodiments, the glove 100 includes more than one magnet.

As the graph indicates, the pull force decreases as the distance between the magnet 112 and the ferromagnetic surface 400 increases. It is critical to strike the right balance of distance and pull force to maintain a strong magnetic connection between the glove 100 and the ferromagnetic surface 400. If the magnet 112 is too deep into the strap 110 (i.e., if there is too much distance between the magnet 112 and the ferromagnetic surface 400), the glove 100 will fall off the ferromagnetic surface 400 because the magnetic connection will be weak. On the other hand, if the strap 110 material between the magnet 112 and the ferromagnetic surface 400 is too thin, the magnetic connection will be strong (i.e., the pull force will be high), but the magnet 112 will damage the strap 110 material after repeated use.

The two circled points on the graph indicate the distances previously discussed in this disclosure: 1.5 mm and 2.75 mm. As discussed with reference to FIG. 5, in some embodiments, the first location 402*a* of the magnet 112 is located a first distance 502*a* of 1.5 mm from the ferromagnetic surface 400, and the second location 402*b* of the magnet 112 is located a second distance of 2.75 mm from the ferromagnetic surface 400. The graph shows that these two distances produce a pull force of 2.01 N and 1.05 N, respectively. Stated more broadly, the first location 402*a* of the magnet 112 may be configured to produce a magnetic force of at least 2 N, and the second location 402*b* may be configured to produce a magnetic force of less than 2 N. In some embodiments, the first location 402*a* is configured to produce a magnetic force of about 2 N, and the second location is configured to produce a magnetic force of about 1 N. Like other dimensions disclosed herein, the term "about" means "approximately" and should be understood to have a tolerance of +/−0.1 N.

Though the previous discussion has focused on the first and second locations 402*a*, 402*b* of the magnet 112, the magnet 112 may define a third location located between the first location 402*a* and the second location 402*b*. In some embodiments, the third location of the magnet 112 produces a magnetic force less than the force produced by the first location 402*a* and greater than the force produced by the second location 402*b*. For example, the third location may be located a distance of about 2 mm from the ferromagnetic surface 400 and may produce a magnetic force of about 1.5 N. The magnet 112 may include a fourth location, a fifth location, etc., located between the first location 402*a* and the second location 402*b*.

Though not explicitly labeled in the figures, the disclosure also includes a method of attaching a glove, such as the glove 100, to a ferromagnetic surface, such as the ferromagnetic surface 400. In some embodiments, the method comprises coupling a magnet, like the magnet 112, including a coupling surface, such as the coupling surface 500, to the glove 100. The glove 100 may include a hand-receiving portion, such as the hand-receiving portion 102, including an opening, like the opening 104, four enclosed finger pockets (the finger pockets 106), and an enclosed thumb pocket (the thumb pocket 108). In some embodiments, the opening 104 is configured to receive a hand of a user, and the hand-receiving portion 102 is configured to enclose the hand of the user. The glove may also include a strap, similar to the strap 110, extending from the hand-receiving portion 102 adjacent to the opening 104. The strap 110 may include an outer surface, such as the outer surface 200*a*, configured to contact the ferromagnetic surface 400 and an inner surface, such as the inner surface 200*b*, located opposite the outer surface 200*a*. In some embodiments, the strap 110 is configured to at least partially wrap around the user's wrist, whereby the inner surface 200*b* is fastened to the hand-receiving portion 102 to thereby secure the glove 100 to the hand of the user. The glove 100 may further comprise a cavity, such as the cavity 300, located within the strap 110, and the cavity 300 may define an angled base surface, like the angled base surface 302. In some embodiments, the magnet 112 is located within the cavity 300. The method may further comprise positioning the magnet 112, via the cavity 300, such that the coupling surface 500 is angled with respect to the outer surface 200*a* of the strap 110.

In some embodiments, the magnet 112 defines a first location, such as the first location 402*a*, and a second location, like the second location 402*b*, located opposite the first location 402*a*. The method may further comprise clocking the magnet 112, as previously discussed, such that the first location 402*a* is located a first distance, such as the first distance 502*a*, from the outer surface 200*a* of the strap 110, and the second location 402*b* is located a second distance, such as the second distance 502*b*, from the outer surface 200*a* of the strap 110. In some embodiments, the first distance 502*a* is less than the second distance 502*b*. The method may include arranging and configuring the first location 402*a* of the magnet 112 to exert a magnetic force of at least 2 N, and arranging and configuring the second location 402*b* of the magnet 112 to exert a force of at least 1 N.

In some embodiments, the method includes securing the glove 100 to the ferromagnetic surface 400 and rotating the glove 100 so that the opening 104 of the hand-receiving portion 102 hangs below the magnet 112 and the second location 402*b* of the magnet 112 is located below the first location 402*a* of the magnet 112. When the glove 100 is rotated so that the opening 104 of the hand-receiving portion 102 hangs below the magnet 112 and the second location 402*b* of the magnet 112 is located below the first location 402*a* of the magnet 112, the hand-receiving portion 102 may hang parallel to a ground surface.

Figure 12:
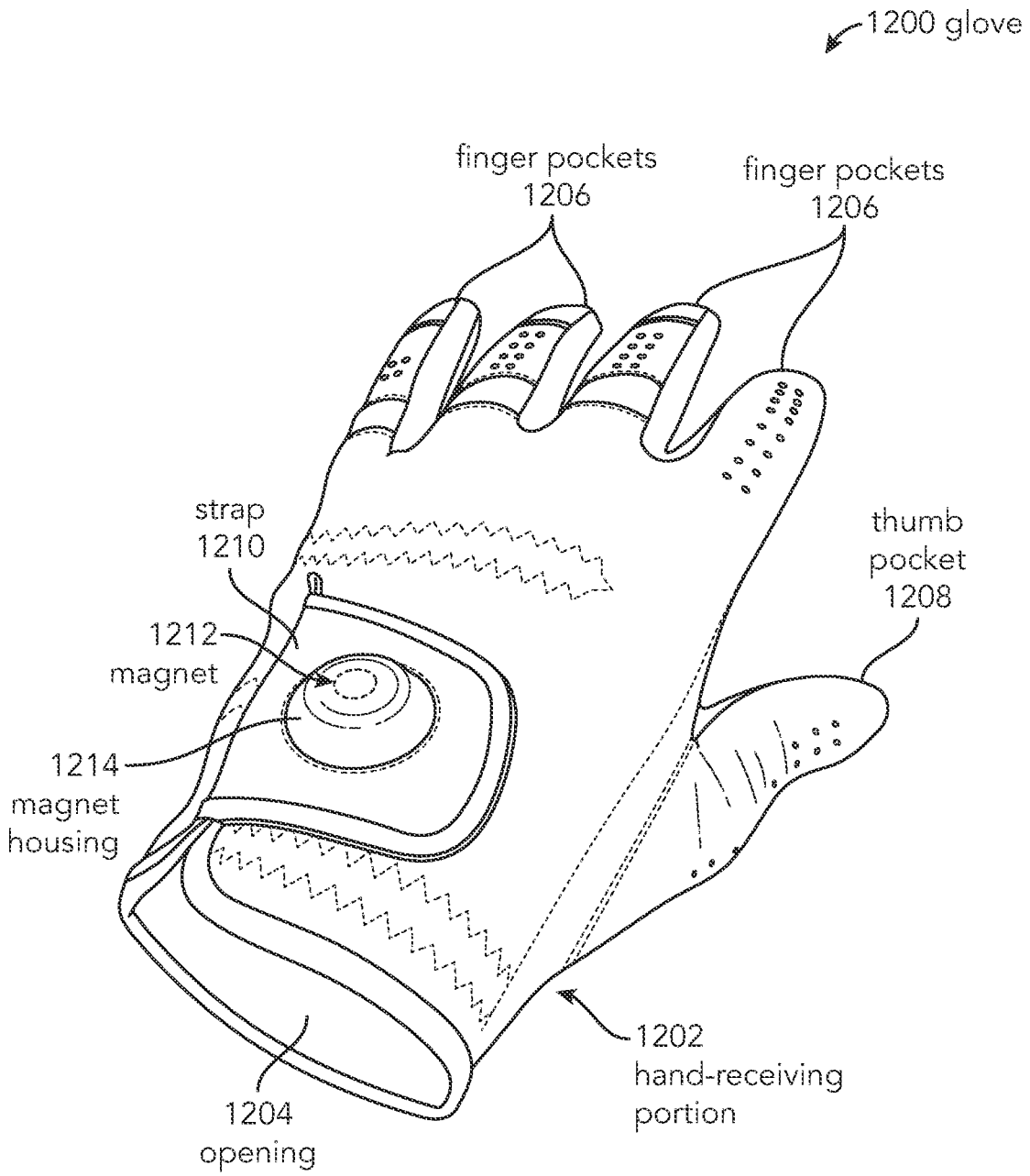
FIG. 12 illustrates a perspective view of a glove, including a magnet housing, according to an embodiment of the present invention.

FIG. 12 illustrates a perspective view of a glove 1200. It should be noted that the glove 1200 may be substantially similar to the glove 100 shown in the previous Figures and may function in much the same way. Accordingly, the glove 1200 may include any of the features of the glove 100 previously discussed in this disclosure and shown in any of the figures.

Further, the glove 1200 may include the same "clocking feature" previously discussed in this disclosure, such that the glove 1200 may be configured to couple to a ferromagnetic surface and hang parallel to the ground, as shown in FIGS. 7 and 8. Also similar to the glove 100, the glove 1200 may include a hand-receiving portion 1202, an opening 1204, finger pockets 1206, a thumb pocket 1208, and a strap 1210, as shown in FIG. 12. In some embodiments, the hand-receiving portion 1202 is substantially similar to the hand-receiving portion 102, the opening 1204 is substantially similar to the opening 104, the finger pockets 1206 are substantially similar to the finger pockets 106, the thumb pocket 1208 is substantially similar to the thumb pocket 108, and the strap 1210 is substantially similar to the strap 110.

FIG. 12 also includes a magnet housing 1214. In some embodiments, the magnet housing 1214 is coupled to the strap 1210 and is configured to contact a ferromagnetic surface, such as a portion of the frame of a golf cart, as shown in FIG. 8. The glove 1200 may also include a magnet 1212 coupled to the magnet housing 1214. In some embodiments, the magnet 1212 is coupled to an interior portion of the magnet housing 1214. The magnet 1212 may be coupled such that the magnet 1212 rests at an angle with respect to the magnet housing 1214, similar to how the magnet 112 is held at an angle within the strap 110, as previously discussed. For example, the magnet housing 1214 may include an angled surface or cavity configured to receive the magnet 1212 and hold the magnet 1212 at a predetermined angle. The magnet 1212 may include a coupling surface configured to couple to the ferromagnetic surface.

Figure 13A:
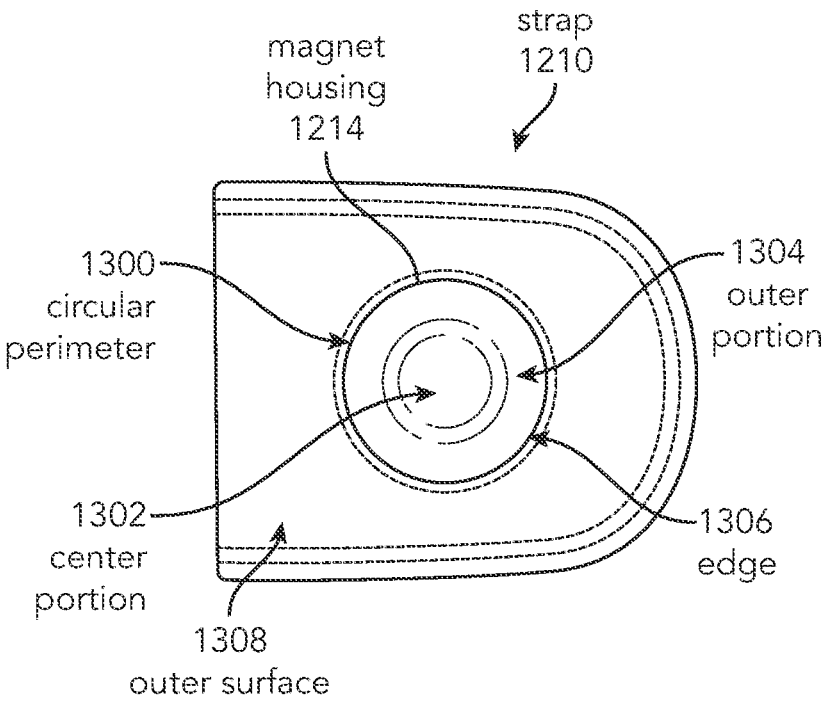
FIG. 13A illustrates a front view of a strap with the magnet housing, according to an embodiment of the present invention.
Figure 13B:
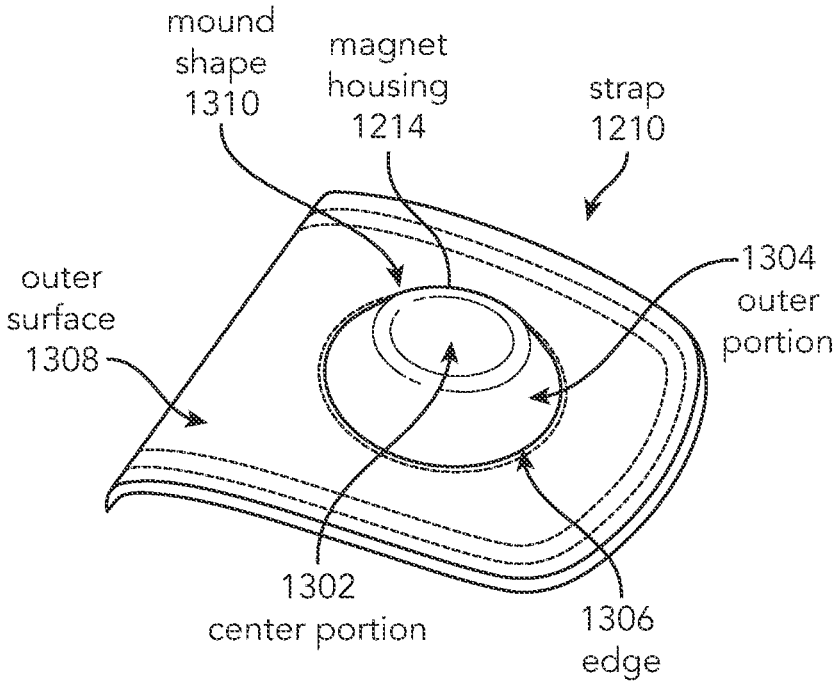
FIG. 13B illustrates a perspective view of the strap with the magnet housing, according to an embodiment of the present invention.

FIGS. 13A and 13B show the strap 1210 detached from the glove 1200. In some embodiments, the magnet housing 1214 defines a substantially circular perimeter 1300, as shown in FIG. 13A. The magnet housing 1214 may include a center portion 1302 and an outer portion 1304 surrounding the center portion 1302. In some embodiments, the outer portion 1304 extends from the center portion 1302 to an edge 1306 of the magnet housing 1214. The edge 1306 may be understood as a portion of the magnet housing 1214 that contacts the outer surface 1308 of the strap 1210. In some embodiments, the outer surface 1308 of the strap 1210 substantially surrounds the edge 1306 of the magnet housing 1214.

The magnet housing 1214 may be configured to protrude from the outer surface 1308 of the strap 1210, as demonstrated in FIG. 13B. In some embodiments, the magnet housing 1214 is coupled to the outer surface 1308 of the strap 1210. The magnet housing 1214 may be coupled to an inner surface of the strap 1210, and protrude through the outer surface 1308. In some embodiments, the magnet housing 1214 is coupled to an interior portion of the strap 1210 between the outer surface 1308 and the inner surface, and protrudes through the outer surface 1308. FIG. 13B also illustrates that, in some embodiments, the outer portion 1304 of the magnet housing 1214 is configured to taper from the center portion 1302 to the edge 1306. Accordingly, the magnet housing 1214 may be thought of as having a mound shape 1310, rather than a circular shape with vertical walls that extend substantially perpendicular to the strap 110, as with the glove 100 shown in FIG. 1.

Similar to the strap 110 of the glove 100 shown in FIGS. 10A, 10B, and 10C, the magnet housing 1214 may comprise a textured surface configured to prevent the glove 1200 from sliding on the ferromagnetic surface. In various embodiments, the textured surface comprises any number of suitable materials including, but not limited to, rubber, silicone, and/or other nonslip materials.

Figure 14:
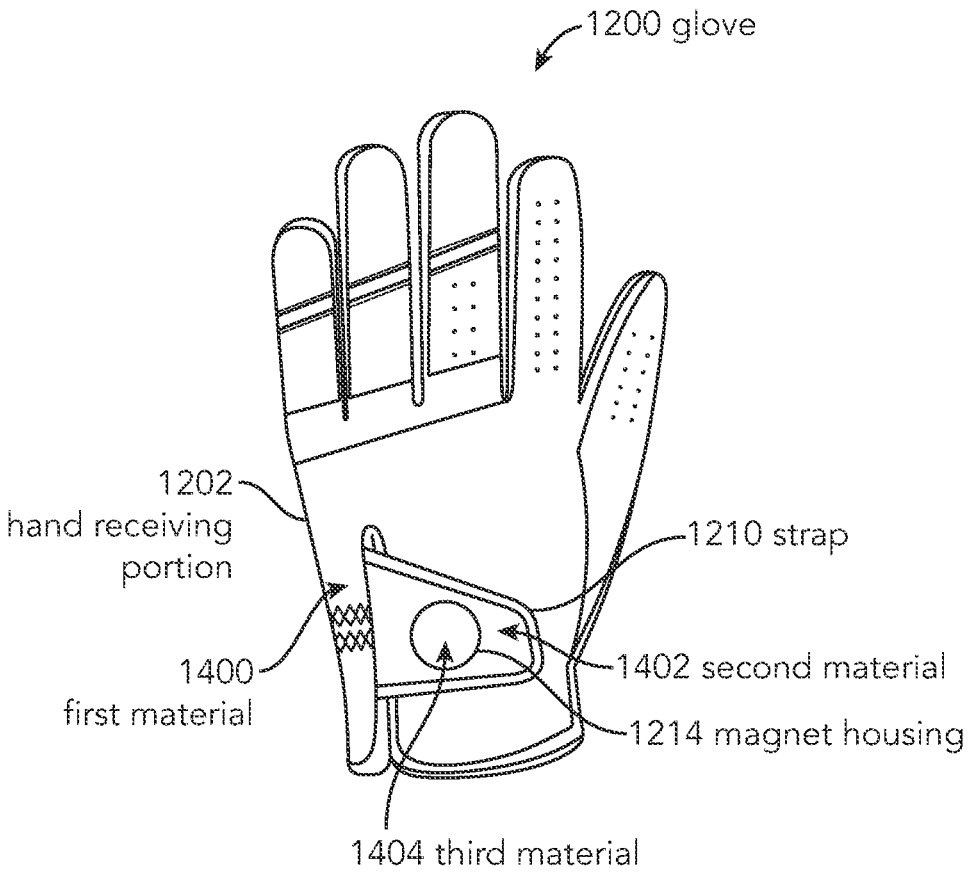
FIG. 14 illustrates a front view of the glove, according to an embodiment of the present invention.

FIG. 14 illustrates that, in some embodiments, the hand-receiving portion 1202 comprises a first material 1400, the strap 1210 comprises a second material 1402, and the magnet housing 1214 comprises a third material 1404. The first material 1400 may be different from the second material 1402, and the third material 1404 may be different from the first material 1400 and the second material 1402. The first material 1400 may comprise leather or synthetic leather, and the second material 1402 may comprise rubber, silicone, polyester, nylon, or the like. The third material 1404 may also comprise rubber, silicone, polyester, nylon, or the like.

In some embodiments, at least one of the first material 1400, the second material 1402, and the third material 1404 comprise the same material.

As previously mentioned, the glove 1200 may include the "clocking feature" discussed with reference to the glove 100. Stated differently, in some embodiments, the magnet 1212 is angled within the magnet housing 1214 to ensure the desired orientation of the glove 1200 when coupled to a ferromagnetic surface so that air can flow through the opening 1204 to dry the interior of the glove 1200. The magnet 1212 may be arranged and positioned such that when the magnet 1212 is coupled to the ferromagnetic surface, the glove 1200 rotates so that the hand-receiving portion 1202 hangs below the magnet 1212 within the strap 1210. In some embodiments, the glove 1200 rotates so that the hand-receiving portion 1202 hangs substantially parallel to a ground surface. In some embodiments, the glove 1200 rotates so that the hand-receiving portion 1202 hangs within +/−10 degrees from parallel to the ground surface. In some embodiments, the glove 1200 rotates so that the hand-receiving portion 1202 hangs within +/−20 degrees from parallel to the ground surface.

Due at least in part to the size and/or position of the magnet 1212, the magnet 1212 may be configured to produce a magnetic pull force sufficient to secure the glove 1200 to the ferromagnetic surface and resist the force of gravity when the glove 1200 is hanging from the ferromagnetic surface. The magnetic pull force produced, in combination with the textured surface on the magnet housing 1214, may prevent the glove 1200 from sliding down, or falling off, the ferromagnetic surface. In some embodiments, the magnet 1212 defines the same size and shape as the magnet 112 previously discussed in this disclosure, and is configured to produce a pull force as shown in the graph of FIG. 11.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc., may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

The term "adjacent" is used to mean "next to" or "adjoining." For example, the disclosure includes, "The glove may also include a strap extending from the hand-receiving portion adjacent the opening . . . " In this context, "adjacent the opening" means that the strap extends from the hand-receiving portion next to, though not necessarily on/at, the opening.

The term "substantially" is used to mean "completely" or "nearly completely." For example, the disclosure includes, " . . . rather than a circular shape with vertical walls that extend substantially perpendicular to the strap 110 . . . " In this context, "substantially perpendicular to the strap" means that the walls may extend completely perpendicular to the strap (i.e., at a 90-degree angle), or may extend nearly completely perpendicular (i.e., at an 85-95-degree angle). For example, "substantially parallel" may be interpreted to mean+/−5 degrees from parallel.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

I claim:

1. A glove, comprising:

a hand-receiving portion including an opening, four enclosed finger pockets, and an enclosed thumb pocket, the opening configured to receive a hand of a user, the hand-receiving portion configured to enclose the hand of the user;

a strap extending from the hand-receiving portion adjacent the opening, the strap including an outer surface and an inner surface located opposite the outer surface, the strap configured to at least partially wrap around a wrist of the user whereby the inner surface is fastened to the hand-receiving portion to thereby secure the glove to the hand of the user;

a magnet housing coupled to the strap and configured to contact a ferromagnetic surface; and a magnet coupled to the magnet housing, the magnet comprising a coupling surface configured to couple to the ferromagnetic surface.

2. The glove of claim 1, wherein the magnet housing protrudes from the outer surface of the strap.

3. The glove of claim 1, wherein the magnet housing defines a substantially circular perimeter.

4. The glove of claim 1, wherein the magnet housing comprises a center portion and an outer portion surrounding the center portion and extending from the center portion to an edge of the magnet housing, and wherein the edge contacts the strap.

5. The glove of claim 4, wherein the outer surface of the strap substantially surrounds the edge of the magnet housing.

6. The glove of claim 4, wherein the outer portion is configured to taper from the center portion to the edge of the magnet housing such that the magnet housing defines a mound shape.

7. The glove of claim 1, wherein the magnet housing comprises a textured surface configured to prevent the glove from sliding on the ferromagnetic surface.

8. The glove of claim 7, wherein the textured surface comprises a material selected from the group consisting of rubber, silicone, and combinations thereof.

9. The glove of claim 1, wherein the hand-receiving portion comprises a first material and the strap comprises a second material that is different from the first material.

10. The glove of claim 1, wherein the hand-receiving portion comprises a first material, the strap comprises a second material that is the same as the first material, and the magnet housing comprises a third material that is different from the first material and the second material.

11. A glove, comprising:

a hand-receiving portion including an opening, four enclosed finger pockets, and an enclosed thumb pocket, the opening configured to receive a hand of a user, the hand-receiving portion configured to enclose the hand of the user;

a strap extending from the hand-receiving portion adjacent the opening, the strap including an outer surface configured to contact a ferromagnetic surface and an inner surface located opposite the outer surface, the strap configured to at least partially wrap around a wrist of the user whereby the inner surface is fastened to the hand-receiving portion to thereby secure the glove to the hand of the user;

a cavity located within the strap; and a magnet coupled to the strap and located within the cavity, the magnet comprising a coupling surface configured to couple to the ferromagnetic surface.

12. The glove of claim 11, wherein the magnet is sized and configured to produce a magnetic pull force sufficient to secure the glove to the ferromagnetic surface and resist the force of gravity when the glove is hanging from the ferromagnetic surface.

13. The glove of claim 11, wherein the magnet is arranged and positioned within the strap to produce a magnetic pull force sufficient to secure the glove to the ferromagnetic surface and resist the force of gravity when the glove is hanging from the ferromagnetic surface.

14. The glove of claim 11, wherein the magnet is arranged and positioned such that when the magnet is coupled to the ferromagnetic surface, the glove rotates so that the opening of the hand-receiving portion hangs below the magnet.

15. The glove of claim 14, wherein the magnet is arranged and positioned such that when the magnet is coupled to the ferromagnetic surface, the glove rotates so that the hand-receiving portion hangs substantially parallel to a ground surface.

16. The glove of claim 11, wherein the outer surface of the strap comprises a textured surface configured to prevent the glove from sliding on the ferromagnetic surface.

17. The glove of claim 16, wherein the textured surface comprises a surface selected from the group consisting of an elongated ribbed surface, a grid-patterned surface, and combinations thereof.

18. The glove of claim 11, wherein the cavity comprises a material selected from the group consisting of rubber, silicone, polyester, nylon, plastic, cotton, and combinations thereof.

19. The glove of claim 11, wherein the magnet defines a shape selected from the group consisting of a rectangular shape, a round shape, and an oblong shape.

20. The glove of claim 11, wherein the hand-receiving portion comprises a first material and the strap comprises a second material, and at least a portion of the second material is different from the first material.

* * * * *